US005572769A

United States Patent [19]

Spechts et al.

[11] Patent Number: 5,572,769

[45] Date of Patent: Nov. 12, 1996

[54] ADJUSTABLE CABLE-SUPPORTING HINGE ASSEMBLY

[75] Inventors: Lee Spechts, Billerica; Paul Tirrell, Uxbridge, both of Mass.

[73] Assignee: EMC Corporation, Hopkington, Mass.

[21] Appl. No.: 361,969

[22] Filed: Dec. 22, 1994

Related U.S. Application Data

[63] Continuation-in-part of Ser. No. 20,175, Mar. 17, 1994, Pat. No. Des. 362,243.

[51] Int. Cl.[6] ..... E05C 17/64; E05D 11/08

[52] U.S. Cl. ..... 16/337; 16/342; 403/71; 361/807; 174/86

[58] Field of Search ..... 16/386, 342, 337, 16/338, 352, 353, 319, 362, 363; 403/71, 70, 68; 361/807, 679, 680, 681, 682, 683, 684, 685, 686; 174/86, 84 R, 68.3

[56] References Cited

U.S. PATENT DOCUMENTS

| | | | |
|---|---|---|---|
| 2,772,916 | 12/1956 | Jones | 16/342 |
| 4,781,422 | 11/1988 | Kimble | 16/337 |
| 4,986,507 | 1/1991 | Chiang | 16/342 |
| 5,043,846 | 8/1991 | Kinoshita | 361/394 |
| 5,052,078 | 10/1991 | Hosoi | 16/297 |
| 5,088,156 | 2/1992 | Hosoi | 16/342 |
| 5,131,779 | 7/1992 | Sen | 16/342 |
| 5,141,446 | 8/1992 | Ozouf et al. | 16/337 |

*Primary Examiner*—Chuck Y. Mah

*Attorney, Agent, or Firm*—Daniel J. Bourque; Kevin J. Carroll

[57] ABSTRACT

An adjustable cable supporting hinge assembly pivotably couples a support member, such as a tray for holding an electronic component, to a support structure, such as a housing or cabinet for an electronic system. The adjustable cable supporting hinge assembly includes a hollow cylindrical hub member which receives the cables coupling the electronic component to the electronic system. The cables are inserted into a cable-receiving region in the hollow cylindrical hub member during assembly and are protected against damage when the pivotable support member is moved. The adjustable wire supporting hinge assembly further includes an adjustable clamp member which rotatably supports and clamps the hollow cylindrical hub member. The adjustable clamp member is adjustable to provide a variable resistance against rotation for the pivotable support member to accommodate electronic components of different sizes and different weights.

17 Claims, 3 Drawing Sheets

ADJUSTABLE CABLE-SUPPORTING HINGE ASSEMBLY

This application is a continuation-in-part of U.S. design patent application Ser. No. 29/020,175 filed on Mar. 17, 1994 now U.S. Pat. No. Des. 362,243.

FIELD OF THE INVENTION

This invention relates to a hinge assembly for a pivotable electronic component support member and in particular, to a tension adjustable, hollow hinge assembly for receiving and supporting cables connected to a pivotally supported electronic component.

BACKGROUND OF THE INVENTION

In some prior electronic systems, such as a computer system, two or more components have been coupled by a pivotable support member or hinge, which allows at least one of the components to pivot to different positions relative to the other.

One problem with having electronic components pivotably coupled is that wires or cables coupling the electronic components often get twisted and pulled causing strain on the conductive wires in the cables which damages the cables and disrupts the electrical connection. Also, the force on the cables often causes connectors to be unplugged from the electronic component or the electronic system. Frequent pivoting of the electronic component also wears down the cables and weakens or breaks the electrical connection with use. Thus, critical communication between the electronic components, such as between a keyboard and electronic system is lost.

In other electronic systems, such as computer systems, which are housed in a cabinet, a fold-out tray is pivotably coupled to the electronic cabinet allowing access to an electronic component supported on the tray, such as a computer keyboard or laptop computer. A further disadvantage with such past electronic component pivotable support members is that they are specifically designed for only a certain electronic component. The hinge assemblies which pivotably couple the support members to a housing such as a cabinet, typically are not designed for different sizes of electronic components having different weights and numbers of cables. If a heavy electronic component is disposed on a pivotable support member designed for a lighter electronic component, the pivotable support member may accidentally swing open causing severe damage to the electronic component or the electrical connection to the electronic system.

Accordingly, what is needed is a hinge assembly for pivotably supporting an electronic component which is adjustable as to tension or pivot resistance, and which is capable of receiving and supporting cables. The hinge assembly should be adjustable to allow electronic components of various sizes and weights to be pivotably supported. The hinge assembly should further accommodate the cables coupling the electronic component to an electronic system so that the cables are not damaged and a secure electrical connection is maintained.

SUMMARY OF THE INVENTION

The present invention features an adjustable cable supporting hinge for a pivotable support member, such as for supporting an electronic component. The adjustable cable supporting hinge assembly includes a hollow cylindrical hub member having a first end, a second end, and a cable receiving region extending from the first end to the second end. The adjustable cable supporting hinge assembly further includes a clamp member having a mounting portion, and a hub member supporting portion forming a generally cylindrically shaped hub member support region to rotatably receive the hollow cylindrical hub member.

The first end of the hollow cylindrical hub member is fixably mounted to a pivotable support member. The mounting portion of the clamp member is mounted to a support structure, so that the pivotable support member pivots in relation to the support structure. In one embodiment, the hollow cylindrical hub member includes a hub member mounting portion for mounting to the pivotable support member and having a first diameter larger than a second diameter of the second end.

The cable receiving region receives and supports cables coupling a first electronic component to a second electronic component, such as an electronic component disposed on the pivotable support member. One example of the pivotable support member includes a pivotable tray for holding an electronic component, such as a computer keyboard or laptop PC.

In the preferred embodiment, the hollow cylindrical hub member further includes a cable receiving slot extending generally longitudinally along an axis from the first end to the second end and opening into the cable-receiving region, to receive the cables which are to be supported and positioned in the cable-receiving region. The pivotable support member to which the hollow cylindrical hub member includes a slot corresponding to the cable-receiving slot in the hollow cylindrical hub member, to receive cables after the hollow cylindrical hub member has been mounted. Thus, the adjustable cable supporting hinge assembly is capable of receiving cables having large connectors mounted at their end, to support and prevent damage to those cables.

In the preferred embodiment, the adjustable cable supporting hinge assembly includes a tension adjusting mechanism which provides a variable pressure by at least the hub member supporting portion against the hollow cylindrical hub member, to provide resistance against rotation. Preferably, the tension adjusting mechanism includes a clamping portion extending from the hub member supporting portion of the clamp member and a fastener coupling the clamping portion, to the mounting portion of the clamp member. Accordingly, the clamp member is adjustably tightened against the hollow cylindrical hub member to accommodate various electronic components having different weights.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
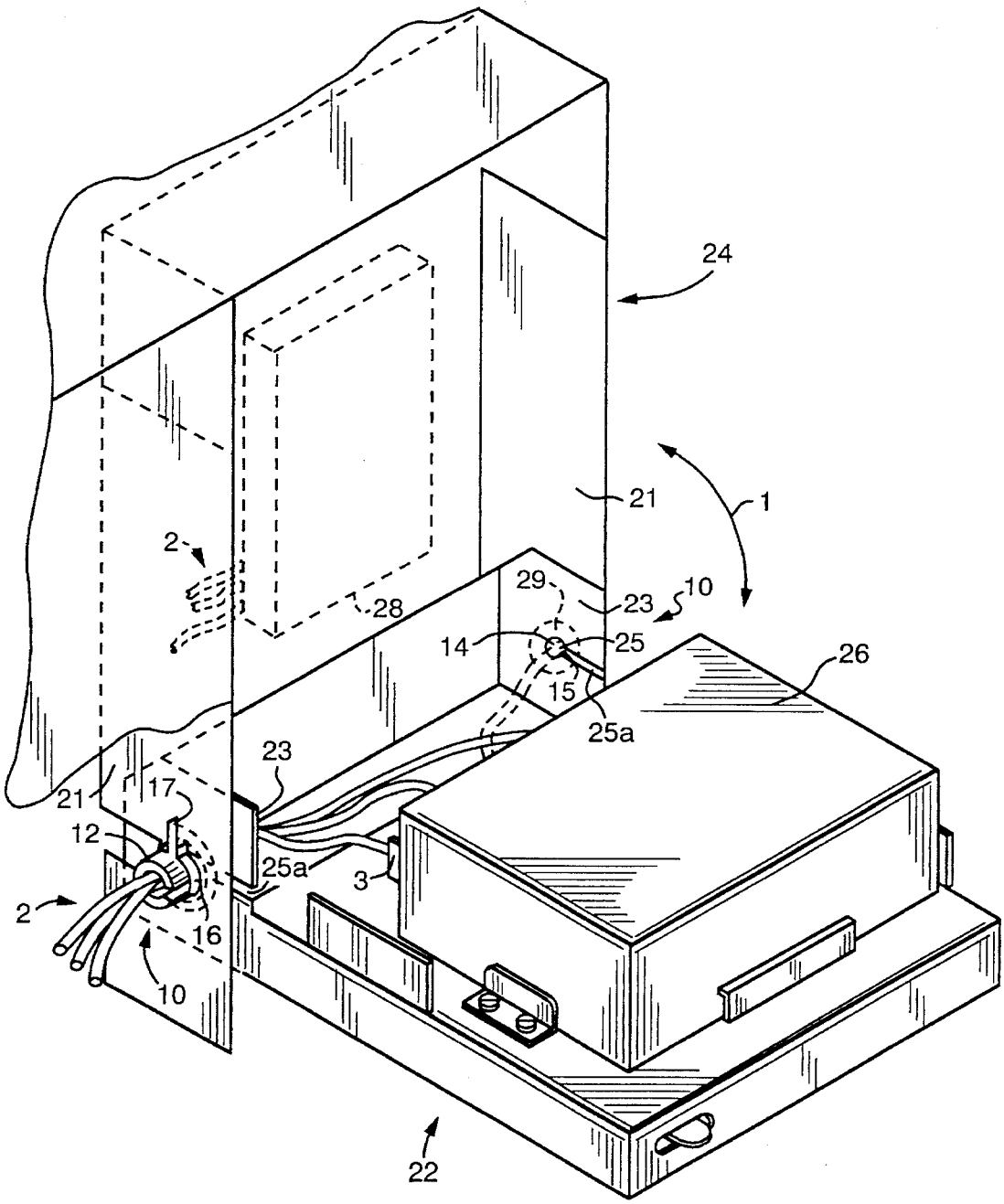
FIG. 1 is a perspective view of an adjustable cable-supporting hinge assembly according to the present invention pivotably coupling an electronic component support member to a structure.

An adjustable cable supporting hinge assembly 10, FIG. 1, according to one aspect of the present invention, includes a hollow cylindrical hub member 12 and a clamp member 16 which pivotably couple a first structure 24 to a second structure, such as pivotable support member 22. The hollow cylindrical hub member 12 is fixed to the second structure, such as pivotable support member 22, and is rotatably received in the clamp member 16 which is fixed to the first support structure 24. The first structure 24 includes a first electronic component or system 28 electrically connected to a second electronic component 26 supported by pivotable support member 22 which pivots in the direction of arrow 1.

One or more wires, cables or other such connection members 2 electrically connect first and second electronic components 26, 28 by connectors 3. The cable(s) 2 are supported in the hollow cylindrical hub member 12 of the adjustable cable supporting hinge assembly 10 to prevent damage when the second electronic component 26 is pivoted with respect to the first electronic component or system 28. When the electronic component and support member 22 are pivoted, the hollow cylindrical hub member 12 and cable 52 supported therein rotate with respect to the clamp member 16 which is fixed to support structure 24.

In one embodiment, the first structure 24 includes a housing for an electronic system 28, such as a cabinet housing a large computer system. The pivotable support member 22 may include a fold out tray pivotably coupled to the cabinet for supporting a keyboard or other such device interacting with the computer system. One or two adjustable cable supporting hinge assemblies 10 can be used to pivotably couple the pivotable support member 22 depending on the number of cables, the size of the electronic component 26, and the overall design of the electronic system 28. The present invention also contemplates two electronic components directly pivotably coupled to one another with an adjustable cable supporting hinge assembly 10. In this embodiment, the hollow cylindrical hub member 12 is fixed in a clamp member 16 which is fixed directly to a second electronic component.

In the exemplary embodiment, a hollow cylindrical hub member 12 is mounted to each side portion 23 of the pivotable support member 22. A cable receiving region 14 extends generally longitudinally along an axis of each hollow cylindrical hub member 12. The cable receiving region 14 receives and supports the cables 2 extending from the first electronic component 28 to the second electronic component 26.

One manner of mounting the hollow cylindrical hub member 12 includes positioning one end of hollow cylindrical hub member 12 against the side portion 23 or pivotable support member 23, and securing one or more threaded fasteners 29 through the side portion 23 and into corresponding threaded bores in the hollow cylindrical hub member 12. Other ways of mounting or fastening the cylindrical hub member to the pivotable support member 22 and associated fasteners are contemplated by the present invention and well known in the art.

The side portion 23 of the pivotable support member 22 further includes a corresponding cable-receiving region 25. The cables 2 are received in the cable-receiving region 14 in the hollow cylindrical hub member 12 and the corresponding cable-receiving region 25 in the side portion 23.

Typically, the cables 2 include connectors 3 which are too large to fit through the cable-receiving region 14 in the hollow cylindrical hub member 12. Thus, the preferred embodiment of the present invention includes a cable receiving slot 15 in the hollow cylindrical hub member 12 and corresponding cable receiving slot **25*a* in the side portion 23 of support member 22. The cables may be inserted through cable-receiving slot 25 in the side portion 23 of the pivotable support member 22, through the cable-receiving slot 15 in the hollow cylindrical hub member 12, and into the cable-receiving region 14 in the hollow cylindrical hub member 12. Subsequently, the connectors 3 may be electrically connected to the connection region on an electronic component 26**.

After mounting hollow cylindrical hub members 12 to pivotable support member 22, the pivotable support member 22 is pivotably coupled to a support structure 21 which is part of or attached to first structure 24 with the clamp member 16. The clamp member 16 is inserted over the hollow cylindrical hub member 12 so that clamp member 16 rotatably receives the hollow cylindrical hub member 12. Typically, the clamp member 16 includes a mounting portion 17 which is attached to the support structure 21 so that the clamp member 16 abuts one side of the support structure 21. Alternative embodiments of the present invention contemplate a clamp member 16 which is already mounted to or one-piece with the support structure 21.

Figure 2:
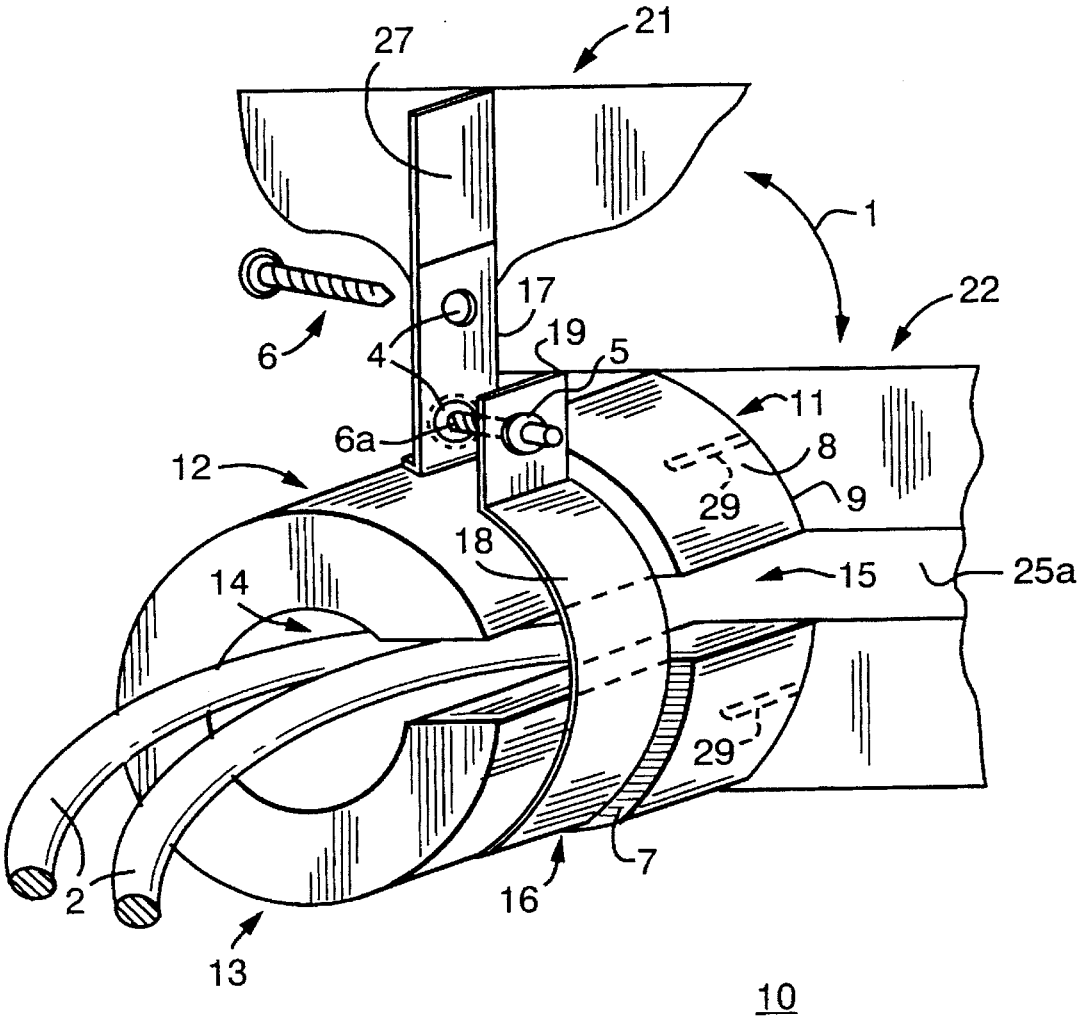
FIG. 2 is a perspective view of an adjustable cable-supporting hinge assembly according to the present invention.

Each adjustable cable-supporting hinge assembly, 10, FIG. 2, according to one aspect of the present invention, includes hollow cylindrical hub member 12 which is removably mounted to pivotable support member 22 and rotatably received in clamp member 16 which is removably mounted to support structure 21. The hollow cylindrical hub member 12 includes a first end 11 and a second end 13. Cable-receiving region 14 extends from the first end 11 to the second end 13 and preferably, concentric with the hollow cylindrical hub member 12. The cable-receiving region 14 is adapted to receive one or more cables or wires 2 or other such flexible connection members extending between a first electronic system or component and a second electronic system or component (see FIG. 1).

In the preferred embodiment, the cable-receiving slot 15 extends longitudinally from the first end 11 to the second end 13 of the hollow cylindrical hub member 12. The cable-receiving slot 15 communicates with the cable-receiving region 14 so that cables or wires 2 can be received in the cable-receiving slot 15 and easily positioned in the cable-receiving region 14.

The preferred embodiment of the hollow cylindrical hub member 12 further includes a mounting portion 8 at the first end 11 having a first diameter larger than a second diameter at the second end 13 of the hollow cylindrical hub member 12. As mentioned above, one way of mounting the hollow cylindrical hub member 12 to pivotable support member 22 is by fasteners 29 extending into mounting portion 8 at the first end 11. The hub member mounting portion 8 includes an annular support surface 7 adapted to frictionally abut a surface of the support structure 21 and a first end surface 9 which is adapted to abut the pivotable support member 22, when mounting portion 8 is mounted to the pivotable support member. Preferably, the hollow cylindrical hub member is made of a plastic material such as delrin, Lexan®, polycarbonate, or other equivalent plastic materials.

The clamp member 16 supports and clamps the hollow cylindrical hub member 12 while allowing the hollow cylindrical hub member 12 to rotate. The clamp member 16 includes a hub member supporting portion 18 which rotatably supports the hollow cylindrical hub member 12. Preferably, the hub member supporting portion 18 forms a generally cylindrical support region which receives the hollow cylindrical hub member 12 and frictionally engages the hollow cylindrical hub member 12.

In the preferred embodiment, the clamp member 16 is a band formed of a flexible resilient material such as metal or an equivalent plastic material, and the mounting portion 17 is formed as a radially extending portion of the band. One way of mounting the radially extending mounting portion 17 to a support structure 21 is by fasteners 6 extending through apertures in the mounting portion 17 and corresponding apertures in a support structure 21. The exemplary embodiment shows the support structure mounting portion 27 extending from the support structure 21 to mount flat against the radially extending mount portion 17. The present invention also contemplates other ways of mounting the mounting portion 17 known to those skilled in the art.

The adjustable cable supporting hinge 10, further includes a tension adjusting mechanism which adjusts the pressure of the hub member supporting portion 18 of the clamp member 16 against the hollow cylindrical hub member 12. Preferably, the tension adjusting mechanism includes a clamping portion 19 radially extending from the hub member supporting portion 18 and an adjustable fastener **6*a* extending from the radially extending mounting portion 17 to the radially extending clamping portion 19. For example, a threaded fastener 6*a*, or other similar fastener, can extend through apertures 4 in mounting portion 17 and engage with a corresponding threaded portion 5 on the clamping portion 19. Accordingly, the hub member supporting portion 18 tightens against the hollow cylindrical hub member 12** to increase the pressure and frictional force providing resistance against rotation.

In one embodiment, the length of the hollow cylindrical hub member 12 is approximately 1.25 inches; the second diameter of the second end 13 is approximately 1.25 inches; the larger first diameter of the first end 11 is approximately 1.375 inches; the diameter of the cable-receiving region 14 is approximately 0.625 inches; and the width of the cable-receiving slot 15 is approximately 0.4 inches. In this embodiment, the generally cylindrical hub member supporting region 18 of the clamp member 16 has a diameter of approximately 1.26 inches; the mounting portion extends radially approximately 1.62 inches; the clamping portion 19 extends radially approximately 0.63 inches; and the width of the clamp member 16 is approximately 0.62 inches. However, the present invention contemplates other dimensions of the hollow cylindrical hub member 12 and clamp member 16.

Figure 3:
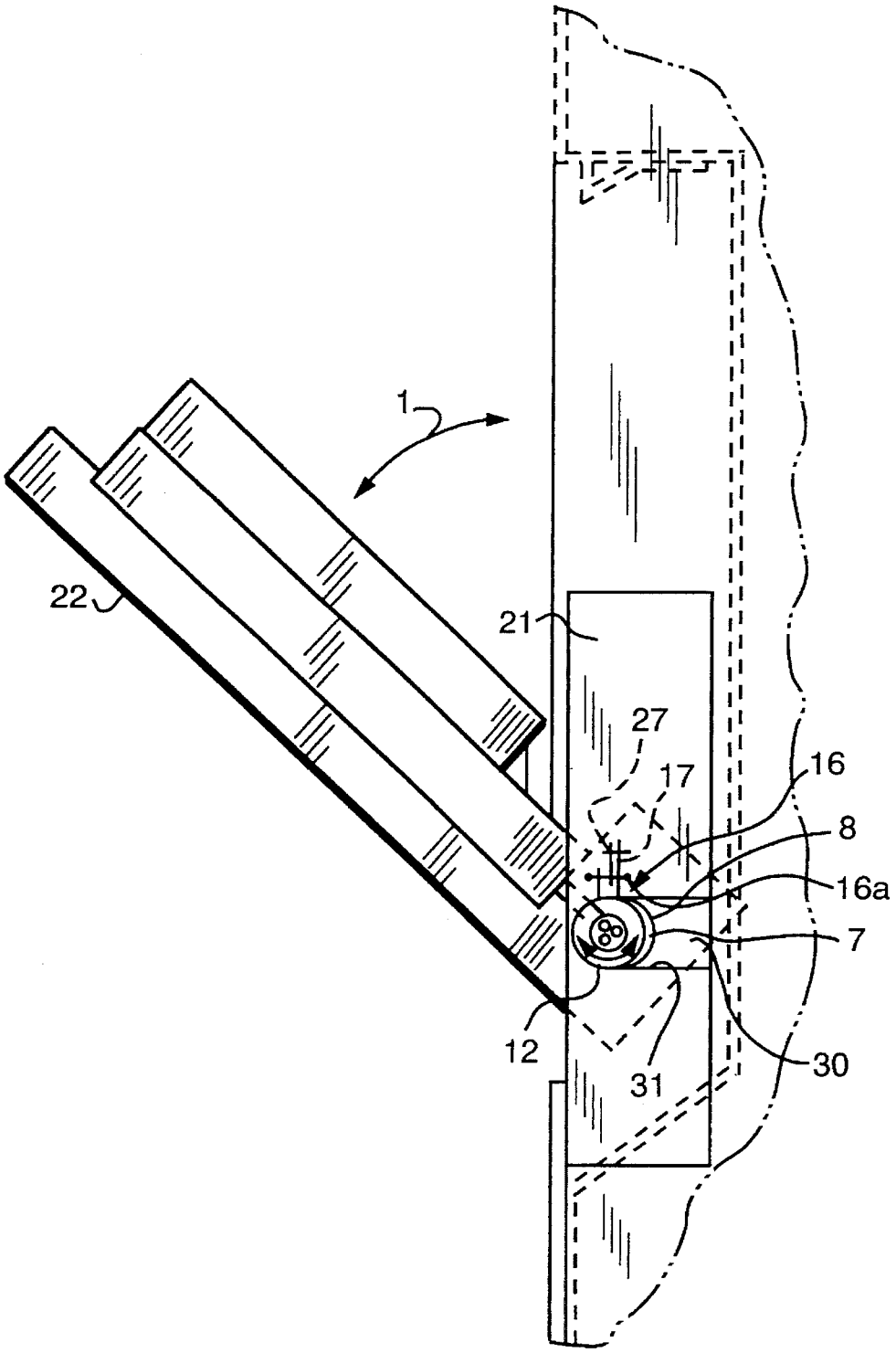
FIG. 3 is a side view of the adjustable cable-supporting hinge assembly mounted to a support structure and pivotably supporting an electronic component support member.

When the pivotable support member 22 is pivoted to an open or closed position, FIG. 3, the hollow cylindrical hub member 12 rotates with the support member 22 while the clamp member 16 is held stationary relative to support structure 21 by the radially extending mounting portion 17 mounted to support structure mounting portion 27 extending from the support structure 21. The fastener 6 extends through the mounting portion 17 to engage the support structure mounting portion 27, such as by engaging a corresponding threaded region of the support structure mounting portion 27. The fastener **6*a* extends through the support structure mounting portion 17 of clamp member 16, through the support structure mounting portion 27, and engages the radially extending clamping portion 17** for adjusting the clamp.

The hollow cylindrical hub member 12 supported by the clamp member 16 is positioned so that annular support surface 7 of the hub member mounting portion 8 abuts the side of support structure 21. The support structure 21 may also include a slot 30 which receives the portion of the hollow cylindrical hub member 12 having the smaller diameter and has a lower edge 31 to provide additional support for the hollow cylindrical hub member 12.

The clamp member 16 is then adjusted accordingly to provide a desired resistance against rotation. For example, a heavier electronic component 26 will require additional tightening of the clamp member 16 around the hollow cylindrical hub member 12 so that the pivotable support member 22 will not swing open too quickly causing damage to the electronic component 26, the cables 2, the connectors 3, or an individual using the electronic component.

Accordingly, the adjustable cable supporting hinge assembly of the present invention provides support and strain relief for cables or other flexible connection members passing through the hollow cable supporting hinge assembly to connect to an electronic component. The adjustable cable support hinge assembly prevents the cables from becoming damaged and prevents loss of electrical connection. Furthermore, the adjustable cable supporting hinge assembly is adjustable to provide a varying resistance against rotation, so that a pivotable support member coupled by the adjustable cable supporting hinge assembly can support electronic components of varying sizes and weights.

Modifications and substitutions by one of ordinary skill in the art are considered to be within the scope of the present invention which is not to be limited except by the claims which follow.

What is claimed is:

1. An adjustable cable-supporting hinge assembly for a pivotable support member, said adjustable cable supporting hinge assembly comprising:

a hollow cylindrical hub member having a first end, a second end, and a cable-receiving region extending from said first end to said second end, said first end fixably mountable to said pivotable support member, said cable-receiving region for receiving at least one cable extending from a first electronic component to a second electronic component supported by said pivotable support member; and a clamp member including a mounting portion for mounting said clamp member to a support structure, and a hub member supporting portion having a generally cylindrically shaped hub member receiving region adapted to receive said hollow cylindrical hub member, wherein said hollow cylindrical hub member rotates in said generally cylindrical hub member receiving region.

2. The adjustable cable-supporting hinge assembly of claim 1, wherein said clamp member includes a tension adjusting mechanism, for providing a variable pressure by at least said hub member supporting portion against said hollow cylindrical hub member, for providing a variable resistance against rotation of said hollow cylindrical hub member in said generally cylindrically shaped hub member receiving region.

3. The adjustable cable-supporting hinge assembly of claim 2, wherein said tension adjusting mechanism includes a clamping portion extending from said hub member supporting portion; and wherein said tension adjusting mechanism further includes a fastener extending from said clamping portion to said mounting portion of said clamp member, wherein tightening said fastener increases the variable pressure by said hub member supporting portion and said clamping portion of said clamp member against said hollow cylindrical hub member.

4. The adjustable cable supporting hinge assembly of claim 1, wherein said hollow cylindrical hub member includes a cable-receiving slot extending generally longitudinally along an axis from said first end to said second end of said hollow cylindrical hub member and adjacent said cable-receiving region, wherein said cable-receiving slot is adapted to receive said at least one cable extending from said first electronic component to said second electronic component.

5. The adjustable cable supporting hinge assembly of claim 1, wherein said mounting portion of said clamp member extends radially from said hub member supporting portion, said mounting portion including apertures for receiving fasteners mounting said mounting portion to said support structure.

6. The adjustable cable-supporting hinge assembly of claim 1, wherein said first end of said hollow cylindrical hub member includes a hub member mounting portion having a diameter larger than a diameter of said second end of said hollow cylindrical hub member.

7. The adjustable cable-supporting hinge assembly of claim 6, wherein said hub member mounting portion of said first end of said hollow cylindrical hub member includes at least one threaded bore, for receiving a fastener and mounting said hollow cylindrical hub member to said pivotable support member.

8. The adjustable cable supporting hinge assembly of claim 1, wherein said hollow cylindrical hub member is made of a plastic material.

9. The adjustable cable supporting hinge assembly of claim 8, wherein said plastic material is a polycarbonate.

10. A pivotable electronic component assembly, comprising:

a first structure including at least a first electronic component;

a second structure pivotably coupled to said first structure, and including at least a second electronic component having at least one cable coupled between said at least a first and at least a second electronic component; and an adjustable cable-supporting hinge assembly removably mounted to said first structure and to said second structure, for pivotably and adjustably coupling said second structure to said first structure, said adjustable cable-supporting hinge assembly including:

a hollow cylindrical hub member having a first and second end, wherein said hollow cylindrical hub member includes a cable receiving region extending from said first end to said second end of said hollow cylinder member adapted to receive said at least one cable coupled between said at least a first and at least a second electronic components and to allow said at least one cable to rotate with said second structure while supporting said at least one cable, and wherein said hollow cylindrical hub member includes a cable-receiving slot extending substantially longitudinally along an axis from said first end to said second end of said hollow cylindrical hub member and adjacent said cable receiving region, wherein said cable-receiving slot is adapted to receive said at least one cable extending between said at least first and second electronic components.

11. The pivotable electronic component assembly of claim 10, wherein said second structure includes a pivotable electronic component support tray pivotably coupled to said first structure, wherein said adjustable cable-supporting hinge assembly is removably mounted to a side region of said pivotable electronic component support tray.

12. The pivotable electronic component assembly of claim 11, wherein said pivotable electronic component support tray includes a slot in said side region, for receiving said at least one cable to be inserted into said cable receiving region.

13. The pivotable electronic component assembly of claim 10, wherein said adjustable cable-supporting hinge assembly includes a clamp member having a mounting portion for mounting to said first structure and a hub member support portion forming a generally cylindrically shaped hub member support region which rotatably receives and provides a variable pressure against said hollow cylindrical hub member.

14. The pivotable electronic component assembly of claim 13, further including a clamping portion extending from said hub member support portion and a fastener extending from said clamping portion to said mounting portion, for providing said variable pressure by said hub member support portion against said hollow cylindrical hub member.

15. A method of pivotably coupling and supporting a first electronic component electrically connected by at least one flexible connection member to at least a second electronic component, comprising the steps of:

providing an adjustable, cable supporting hinge assembly, said adjustable cable-supporting hinge assembly including:

a hollow cylindrical hub member having a first end, a second end, and a cable-receiving region extending from said first end to said second end, said first end fixably mountable to a pivotable support member, said cable-receiving region for receiving at least one cable extending from said first electronic component to said second electronic component supported by said pivotable support member; and a clamp member including a mounting portion for mounting said clamp member to a support structure, and a hub member supporting portion having a generally cylindrically shaped hub member receiving region adapted to receive said hollow cylindrical hub member, wherein said hollow cylindrical hub member rotates in said generally cylindrical hub member receiving region;

removably attaching said hollow cylindrical hub member to said pivotable support member;

inserting at least one cable into said cable receiving region in said hollow cylindrical hub member;

positioning said pivotable support member in said support structure; and rotatably supporting said hollow cylindrical hub member in said support structure, whereby said at least one cable is secured in said cable receiving region of said hollow cylindrical hub member.

16. The method of claim 15, further including varying pressure exerted by said hub member supporting portion against said hollow cylindrical hub member to vary the force required to pivot the pivotable support member.

17. The method of claim 15, wherein said step of rotatably supporting said hollow cylindrical hub member includes inserting said hollow cylindrical hub member into said clamp member, removably mounting said clamp member to said support structure, and adjustably tightening said clamp member against said hollow cylindrical hub member.

* * * * *